US010900502B2

(12) United States Patent
Otth et al.

(10) Patent No.: US 10,900,502 B2
(45) Date of Patent: Jan. 26, 2021

(54) DIRECT INPUT PILOT OPERATED SERVO VALVE

(71) Applicant: Parker-Hannifin Corporation, Cleveland, OH (US)

(72) Inventors: Alfred W. Otth, Lake Forest, CA (US); Michael D. Kalbfeld, Santa Ana, CA (US)

(73) Assignee: Parker-Hannifin Corporation, Cleveland, OH (US)

( * ) Notice: Subject to any disclaimer, the term of this patent is extended or adjusted under 35 U.S.C. 154(b) by 188 days.

(21) Appl. No.: 16/033,844

(22) Filed: Jul. 12, 2018

(65) Prior Publication Data

US 2019/0063469 A1 Feb. 28, 2019

Related U.S. Application Data

(60) Provisional application No. 62/550,049, filed on Aug. 25, 2017.

(51) Int. Cl.

*F15B 13/04* (2006.01)
*F15B 13/043* (2006.01)
*F15B 13/16* (2006.01)

(52) U.S. Cl.

CPC ..... *F15B 13/0401* (2013.01); *F15B 13/043* (2013.01); *F15B 13/0433* (2013.01); *F15B 13/0435* (2013.01); *F15B 13/0402* (2013.01); *F15B 13/16* (2013.01); *F15B 2013/0409* (2013.01)

(58) Field of Classification Search

CPC ..... F15B 13/0401; F15B 13/043; F15B 13/0433; F15B 13/0435; F15B 13/0402; F15B 13/07; F15B 13/16; F15B 13/2013; F15B 13/0409; F15B 9/00; F15B 9/16; F15B 9/02; F15B 2211/042; F15B 2211/36; F15B 2211/35; F15B 2211/575; G05D 16/2053; F16K 11/161

See application file for complete search history.

(56) References Cited

U.S. PATENT DOCUMENTS 3,777,784 A 12/1973 Nicholson
5,682,744 A * 11/1997 Hasegawa ..... B62D 5/087 137/625.3
5,930,997 A * 8/1999 Hayashi ..... E02F 9/123 60/468

(Continued)

FOREIGN PATENT DOCUMENTS

CN 2775363 4/2006

*Primary Examiner* — Kelsey E Cary
(74) *Attorney, Agent, or Firm* — Renner, Otto, Boisselle & Sklar, LLP

(57) ABSTRACT

An electro hydraulic servo valve and a method of controlling pressure therein includes a first stage unit including a moveable direct drive valve, a second stage unit including a centering spring and a second stage spool valve that is fluidly connected to the moveable direct drive valve, and at least one pressure feedback fluid line fluidly connected to the first stage unit. The moveable direct drive valve selectively supplies fluid pressure to the second stage unit. Motion of the second stage unit is arrested using the centering spring and motion of the first stage unit is arrested when pressure is fed back to the first stage unit. A supply pressure or a return pressure is metered using the pressure feedback fluid line.

17 Claims, 6 Drawing Sheets

(56) References Cited

U.S. PATENT DOCUMENTS

| | | | | |
|---|---|---|---|---|
| 6,786,236 | B2 | 9/2004 | Jansen | |
| 2013/0087223 | A1 | 4/2013 | Ozzello | |
| 2014/0311586 | A1* | 10/2014 | Becker | F16K 11/161 137/15.21 |
| 2014/0366520 | A1* | 12/2014 | Krahn | F15B 13/0402 60/464 |
| 2015/0211211 | A1* | 7/2015 | Sasaoka | E02F 3/961 60/470 |
| 2016/0369480 | A1* | 12/2016 | Mizuochi | E02F 9/2228 |
| 2017/0307090 | A1* | 10/2017 | DeFusco | F16K 11/161 |
| 2018/0009471 | A1* | 1/2018 | Novacek | B62D 5/061 |
| 2018/0281940 | A1* | 10/2018 | Collins | F15B 13/0406 |

* cited by examiner

DIRECT INPUT PILOT OPERATED SERVO VALVE

This application claims priority of U.S. Provisional Patent Application No. 62/550,049 filed Aug. 25, 2017, which is hereby incorporated herein by reference.

FIELD OF INVENTION

The present invention relates to servo valves, and more particularly, to electro hydraulic servo valves.

BACKGROUND

Various applications may use servo valves, and particularly, servo valves may be suitable for use in various hydraulic applications. Hydraulic servo valves are used to magnify a relatively low power input signal to a high power hydraulic output. Examples of suitable applications for hydraulic servo valves include aircraft applications, such as in actuators for various components of an aircraft. Types of hydraulic servo valves include jet pipes and flapper nozzles. The servo valves operate using a first stage unit that has a low power input, and includes an electrical or electromagnetic force motor that controls a flow of hydraulic fluid driving a valve member of a second stage unit. Accordingly, a flow of hydraulic fluid to an actuator driving a load may be controlled. The force motor is operable to move the flapper in response to the input drive signal used to drive the second stage unit valve member. The motor may be moved to the original or null position after the valve member is moved to a desired position.

Conventional servo valves may use mechanical feedback, such as a spring arranged between the first and second stages, to restore the first stage to hydraulic null and arrest the second stage motion. However, conventional servo valves are disadvantageous in that the servo valve may have leakage when the first stage unit is at null. The dynamic performance of the conventional servo valves may also be sensitive to fluid temperature variation. Furthermore, conventional servo valves may be expensive to manufacture due to complex configurations.

SUMMARY OF INVENTION

The present invention is directed towards an electro hydraulic servo valve that uses pressure feedback instead of mechanical feedback. The electro hydraulic servo valve includes a first stage unit driven by a motor, a second stage unit, a pressure feedback line, and control orifices arranged along the pressure feedback line. A pressure differential across a spool of the second stage is fed back to a spool of the first stage. The steady state pressure differential is proportional to the motor current, and the second stage unit further includes a centering spring that enables the position of the second stage spool to be proportional to the pressure differential. The electro hydraulic servo valve is advantageous in preventing first stage leakage when the first stage unit is in a null position since the first stage hydraulic demand is proportional to the hydraulic demand of the second stage. Additionally, the hydraulic fluid flow is metered and dynamically controlled using control orifices. The first stage fluid flow is metered using sharp-edged orifices.

According to an embodiment of the present invention, an electro hydraulic servo valve includes a first stage unit including a moveable direct drive valve, a second stage unit including a centering spring and a second stage spool valve that is fluidly connected to the moveable direct drive valve, and at least one pressure feedback fluid line fluidly connected to the first stage unit. The moveable direct drive valve selectively supplies fluid pressure to the second stage unit. Motion of the second stage unit is arrested using the centering spring. Motion of the first stage unit is arrested when pressure is fed back to the first stage unit. A supply pressure or a return pressure is metered using the pressure feedback fluid line.

According to another embodiment of the invention, an electro hydraulic servo valve includes a first stage unit including a moveable direct drive valve having a first first stage spool valve, a second first stage spool valve, and a motor that drives the first first stage spool valve and the second first stage spool valve, a second stage unit including a centering spring and a second stage spool valve having a first end and a second end opposite the first end, a first pressure feedback fluid line that is connected to the first first stage spool valve and has a first control orifice, and a second pressure feedback fluid line that is connected to the second first stage spool valve and has a second control orifice. The first first stage spool valve is fluidly connected to the first end and the second first stage spool valve is fluidly connected to the second end of the second stage spool to selectively supply fluid pressure to the first end and the second end. A supply pressure is metered using the first pressure feedback fluid line and the second pressure feedback fluid line, and the second stage unit is configured to feed a pressure differential across the second stage spool valve back to the first stage unit.

According to another embodiment, a method of pressure control is used in an electro hydraulic servo valve. The method includes fluidly connecting at least one pressure feedback fluid line to a first stage unit having a direct drive, supplying hydraulic fluid to the first stage unit, supplying hydraulic fluid selectively to a spool of a second stage unit, the direct drive valve being fluidly connected to the spool, and feeding a pressure differential of the second stage unit back to the first stage unit.

Other systems, devices, methods, features, and advantages of the present invention will be or become apparent to one having ordinary skill in the art upon examination of the following drawings and detailed description. It is intended that all such additional systems, methods, features, and advantages be included within this description, be within the scope of the present invention, and be protected by the accompanying claims.

DETAILED DESCRIPTION

Figure 1:
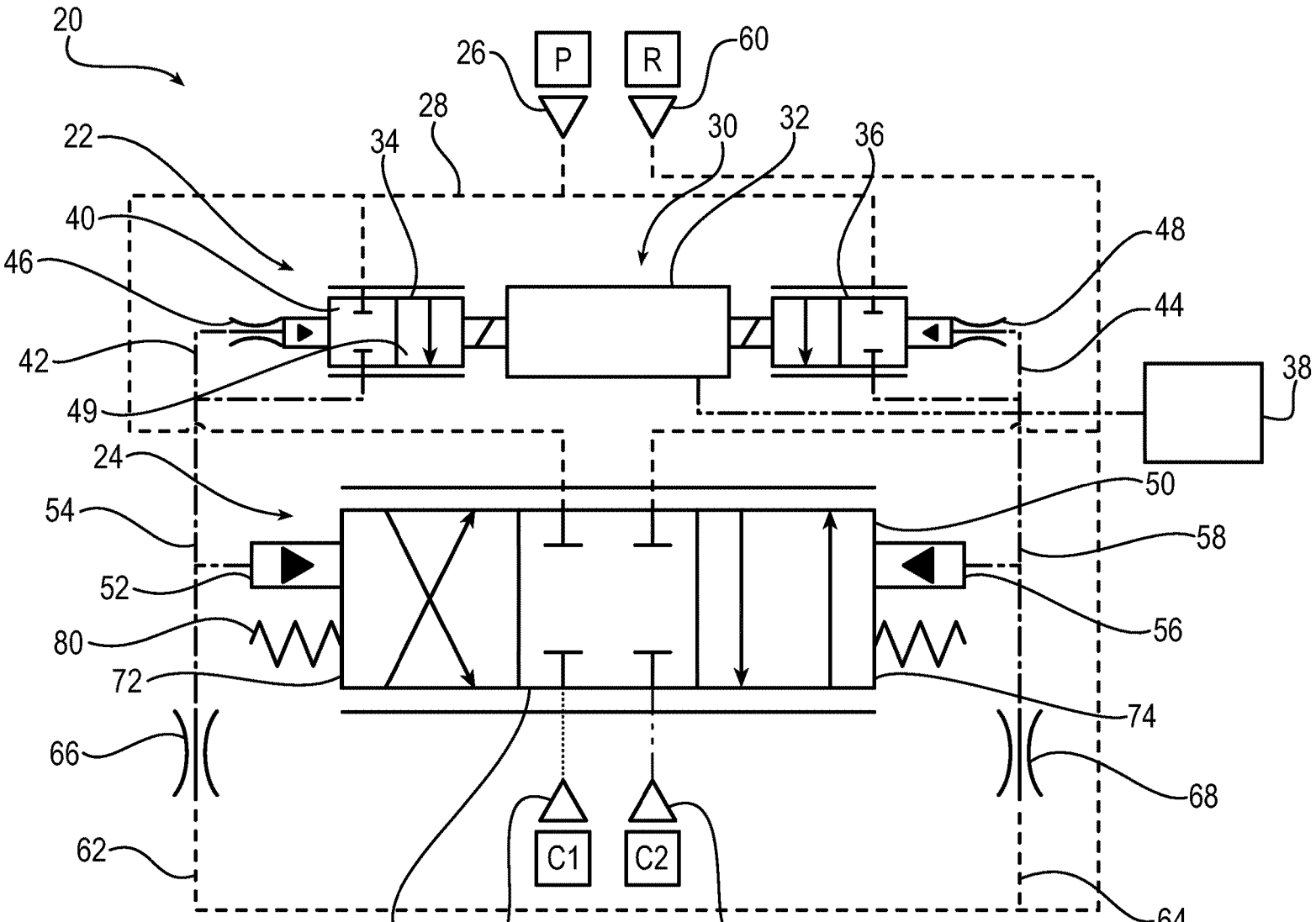
FIG. 1 is a schematic drawing of an electro hydraulic servo valve in accordance with a first embodiment in which the supply pressure is metered.

Aspects of the present invention relate to hydraulic servo valves that are suitable for use in various applications, such as in an aircraft actuator. Referring first to FIG. 1, a schematic drawing of an electro hydraulic servo valve 20 is shown. The electro hydraulic servo valve 20 includes a first stage unit 22 and a second stage unit 24 that controls flow to an actuator, or an actuator cylinder. The first stage unit 22 and the second stage unit 24 are fluidly connected to a supply fluid port 26 via a fluid supply line 28. The first stage unit 22 includes a direct drive valve 30 having a motor 32 that drives at least one first stage spool valve 34, 36. In the configuration shown, the first stage unit 22 includes a first or left side first stage spool valve 34 and a second or right side first stage spool valve 36. It will be appreciated that directional terms such as "left" and "right" are used for convenient reference to the figures, and embodiments are not limited to any particular orientation. Accordingly, more generally the first stage unit 22 includes a first stage spool valve 34 and a second first stage spool valve 36 that separately in fluid communication with the direct drive valve 30.

The motor 32 may be a linear force motor that drives a linear valve or a torque motor that drives a linear or rotary valve. The motor 32 includes an armature that indirectly controls the flow of hydraulic fluid to one side of each of the first stage spool valves 34, 36. Voltage is applied to coils of the motor 32 using a current control loop 38, and the armature of the motor 32 is displaced proportionally to the current. The electrical loop may be open or closed. The displacement causes movement of the first stage spool valves 34, 36 which are each normally in a closed position 40, or a null position in which fluid is not flowing through the first stage unit 22. The first stage unit 22 includes a first pressure feedback fluid line 42 connected to the left side first stage spool valve 34 and a second pressure feedback fluid line 44 connected to the right side first stage spool valve 36. A first control orifice 46 is arranged along the first pressure feedback fluid line 42 and a second control orifice 48 is arranged along the second pressure feedback fluid line 44.

The first stage unit 22 is moveable to an open position 49 in which hydraulic fluid is permitted to flow through the first stage spool valves 34, 36 to the second stage unit 24. The second stage unit 24 may also be supplied by a hydraulic supply fluid that bypasses the first stage unit 22 and flows directly to the second stage unit 24 via the fluid supply line 28. The second stage unit 24 includes a pilot operated hydraulic directional second stage spool valve 50 that is fluidly connected to the first stage unit 22 and is configured to receive hydraulic fluid from the first stage unit 22. The second stage spool valve 50 has a first end 52 that is fluidly connected to the left side first stage spool valve 34 of the first stage unit 22 via a left second stage supply fluid line 54. The second stage spool valve 50 has a second end 56 that is fluidly connected to the right side first stage spool valve 36 of the first stage unit 22 via a right second stage supply fluid line 58. The first end 52 of the second stage spool valve 50 is in fluid communication with a fluid return port 60 via a first return fluid line 62. The second end 56 of the second stage spool valve 50 is in fluid communication with the fluid return port 60 via a second fluid return line 64.

A third control orifice 66 is arranged along the first return fluid line 62 and a fourth control orifice 68 is arranged along the second fluid return line 64 such that fluid returning to the fluid return port 60 flows from the ends 52, 56 of the second stage spool valve 50 and through the control orifices. Any suitable number of control orifices may be used and the control orifices may be arranged to be in series with each other. All of the control orifices 46, 48, 66, 68 may have any suitable size and the size may be adjusted based on the stiffness requirements of a particular application. The control orifices may be fixed or variable. In exemplary embodiments, the first and second control orifices 46, 48 that are arranged on the sides of the first stage unit 22 may be sharp-edged such that the dynamic response of the system may be insensitive to fluid temperature variation. In other embodiments, the area of the third and fourth control orifices 66, 68 may be increased to achieve a higher dynamic response of the second stage unit 24.

The second stage unit 24 is normally in a closed position 70, as shown in FIG. 1. The second stage unit 24 is moveable to an operational position, in which the second stage spool valve 50 is open. The second stage spool valve 50 has a first operational position 72 and a second operational position 74 in which hydraulic fluid is supplied and returned from a first actuator cylinder 76 (C1) and a second actuator cylinder 78 (C2). In the first operational position 72, fluid is supplied to the second actuator cylinder 78 and returned from the first actuator cylinder 76. In the second operational position 74, fluid is supplied to the first actuator cylinder 76 and returned from the second actuator cylinder 78. Any number of actuator cylinders, or second stage outputs, may be used. The second stage unit 24 further includes a centering spring 80 that centers the second stage spool valve 50.

In operation, current is applied to the coils of the motor 32 and the displacement of the armature of the motor 32 is proportional to the current applied. The displacement of the armature of the motor 32 results in a differential pressure across the second stage spool valve 50. The centering spring 80 acts on the second stage spool valve 50 resulting in force equilibrium. Using the centering spring 80 enables the position of the second stage spool valve 50 to be linearly proportional to the pressure differential. The motion of the second stage spool valve 50 is arrested when the force equilibrium is restored. Accordingly, the position of the second stage spool valve 50 is proportional to the current of the motor 32.

The electro hydraulic servo valve 20 also uses pressure feedback instead of the mechanical feedback used in conventional servo valves. Conventional servo valves use mechanical feedback, such as a spring between the first stage unit and the second stage unit, to restore the first stage to a hydraulic null and arrest the second stage motion. In contrast, during operation of the electro servo valve 20, the pressure differential of the second stage spool valve 50 is fed back to the first stage unit 22. Pressure is fed back from the first end 52 of the second stage spool valve 50 through the first pressure feedback fluid line 42 to the left side first stage spool valve 34. Pressure is fed back from the second end 56 of the second stage spool valve 50 through the second pressure feedback line 44 to the right side first stage spool valve 36. The motion of the first stage unit 22 is arrested when the force equilibrium is restored by the feedback pressure. Accordingly, an output delta pressure of the first stage unit 22 is proportional to the current of the motor 32. In an exemplary application, the hydraulic fluid that is supplied to the system may have a pressure of around 3000 pounds per square inch (psi) and a pressure differential of 750 psi across the second stage unit 24 may result. The pressure differential may be fed back to the first stage unit 22 such that the return pressure may be between 75 and 100 psi.

The electro hydraulic servo valve 20 having pressure feedback is advantageous in that leakage in the first stage unit 22 is eliminated since the first stage hydraulic demand is proportional to the second stage hydraulic demand. Using the control orifices 46, 48 arranged at the sides of the first stage unit 22 are advantageous in providing damping of the movement and increasing the resonant frequency of the first stage unit 22. Damping the movement of the first stage unit 22 provides hydraulic stability. Additionally, the electro hydraulic servo valve 20 may be operable using an open or closed electrical loop.

Figure 2:
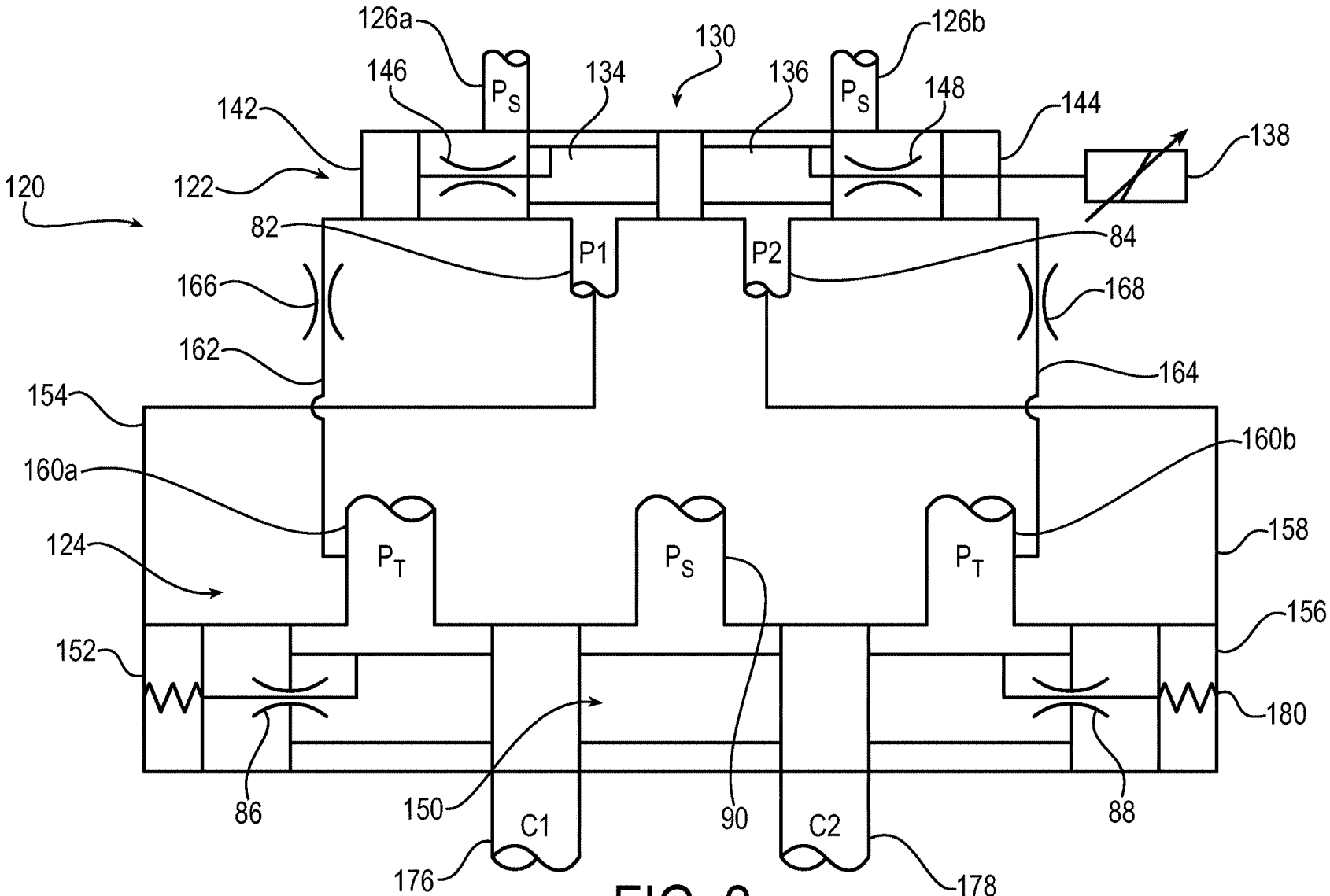
FIG. 2 is a schematic drawing of an electro hydraulic servo valve in accordance with a second embodiment in which the supply pressure is metered and further including additional control orifices.
Figure 3:
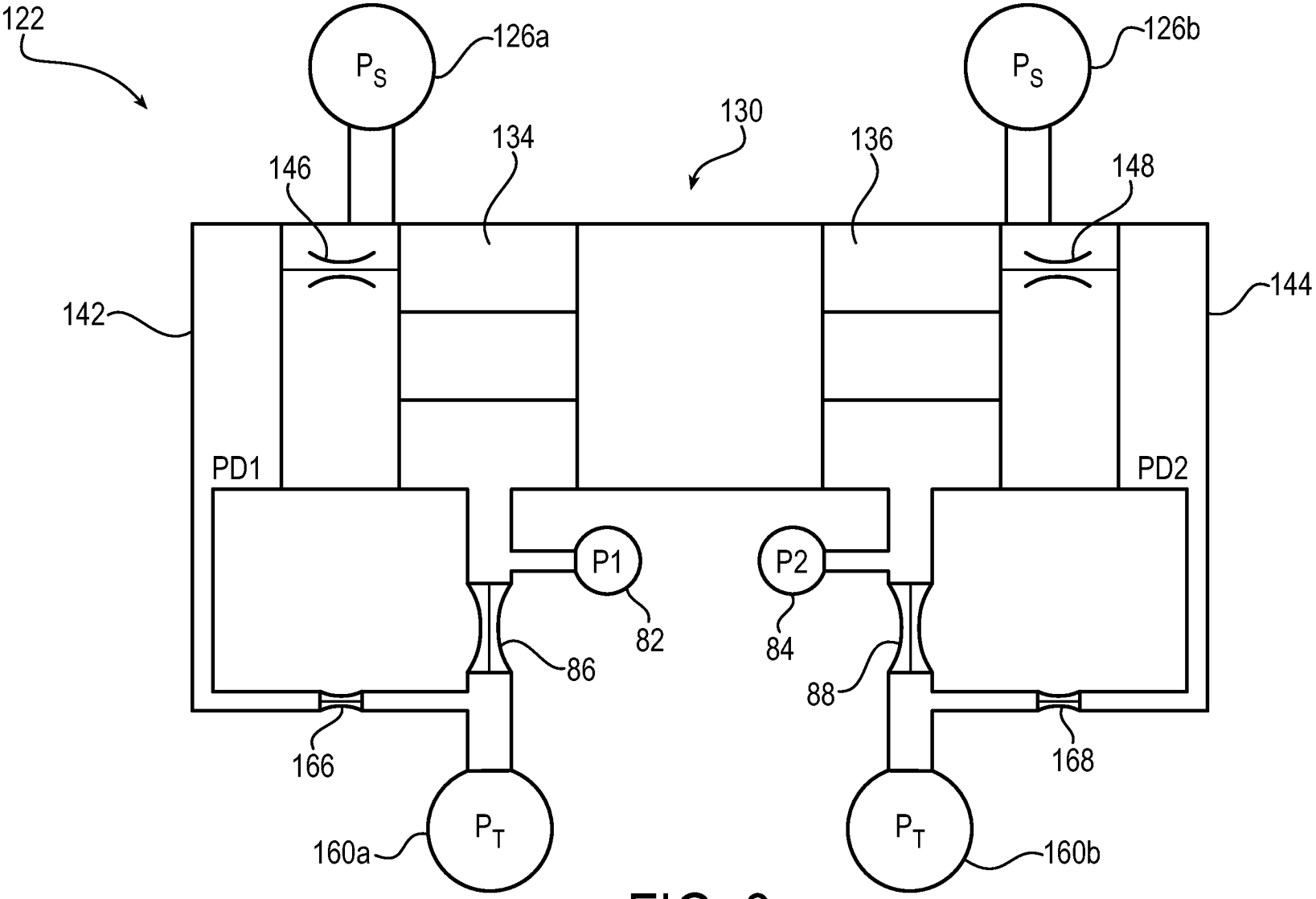
FIG. 3 is a schematic drawing of a first stage unit of the electro hydraulic servo valve of FIG. 2.

Referring now to FIGS. 2 and 3, an electro hydraulic servo valve 120 according to a second embodiment is schematically shown. As in the embodiment shown in FIG. 1, the electro hydraulic servo valve 120 is also configured to meter supply pressure. The embodiment shown in FIGS. 2 and 3 shows a configuration in which the feedback pressure is reduced from the control pressure.

The electro hydraulic servo valve 120 includes the first stage unit 122 and the second stage unit 124 that control flow to the first actuator cylinder port 176 and the second actuator cylinder port 178. FIG. 3 shows another schematic drawing of the first stage unit 122. The first stage unit 122 is connected to a first fluid supply port 126*a* and a second fluid supply port 126*b*. The first stage unit 122 includes the direct drive valve 130 that drives the left side first stage spool valve 134 and the right side first stage spool valve 136. The direct drive valve 130 includes a motor having an armature that is driven proportionally to the amount of current applied to coils of the motor via the current control loop 138. The displacement causes movement of both first stage spool valves 134, 136 which is normally in a null position in which fluid is not flowing through the first stage unit 122. The first stage unit 122 is moveable to an open position in which hydraulic fluid is permitted to flow through one of the spool valves 134, 136 to the second stage unit 124.

The first stage unit 122 includes a first pressure dividing path 142 (denoted as PD1 in FIG. 3) connected to the left side first stage spool valve 134 and a second pressure dividing path 144 (denoted as PD2 in FIG. 3) connected to the right side first stage spool valve 136. The first control orifice 146 is arranged along the first pressure dividing path 142 and the second control orifice 148 is arranged along the second pressure dividing path 144.

When the direct drive valve 130 is in the open position, the hydraulic fluid flows to a first port 82 (P1) and a second port 84 (P2) that are associated with the first stage spool valves 134, 136 respectively. The first port 82 and the second port 84 are in fluid communication with the ends of the second stage spool valve 150. The first port 82 is fluidly connected to the first end 152 of the second stage spool valve 150 via a left second stage supply fluid line 154, and the second port 84 is fluidly connected to the second end 156 via a right second stage supply fluid line 158. Accordingly, fluid is selectively supplied to the second stage unit 124 via the ports 82, 84 and the supply fluid lines 154, 158.

The first stage unit 122 further includes a first fluid return port 160*a* ($P_T$) and a second fluid return port 160*b* ($P_T$) through which hydraulic fluid from the system is returned. The first return fluid line 162 is fluidly connected between the first pressure dividing path 142 and the first fluid return port 160*a*. A third control orifice 166 is arranged along the first return fluid line 162. The second fluid return line 164 is fluidly connected between the second pressure dividing path 144 and the second fluid return port 160*b*. A fourth control orifice 168 is arranged along the second fluid return line 164.

In operation, the left side first stage spool valve 134 is moveable to a first position in which the first fluid supply port 126*a* is in fluid communication with the left side first stage spool valve 134 through which hydraulic fluid flows to the first end 152 of the second stage spool valve 150, and a second position in which the first fluid supply port 126*a* is in fluid communication with the first pressure dividing path 142 through which hydraulic fluid bypasses the left side first stage spool valve 134 and flows to the first fluid return port 160*a*. Similarly, the right side first stage spool valve 136 is moveable to a first position in which the second fluid supply port 126*b* is in fluid communication with the right side first stage spool valve 136 through which hydraulic fluid flows to the second end 156 of the second stage spool valve 150, and a second position in which the second fluid supply port 126*b* is in fluid communication with the second pressure dividing path 144 through which hydraulic fluid bypasses the right side first stage spool valve 136 and flows to the second fluid return port 160*b*.

The second stage unit 124 is normally in a closed position. When hydraulic fluid is supplied to the second stage unit 124, the second stage unit 124 is moveable to an operational position, in which the second stage spool valve 150 is open and in which hydraulic fluid is supplied and returned from the first actuator cylinder port 176 and the second actuator cylinder port 178. Any number of actuator cylinders, or second stage outputs, may be used. The second stage spool valve 150 may include a fifth control orifice 86 that is associated with the first end 152 of the second stage spool valve 150 and a sixth control orifice 88 that is associated with the second end 156. The fifth control orifice 86 is fluidly connected between the left second stage supply fluid line 154 and the second stage spool valve 150. The sixth control orifice 88 is fluidly connected between the right second stage supply fluid line 158 and the second stage spool valve 150.

The second stage unit 124 further includes a second stage supply pressure port 90 that supplies fluid directly to the first actuator cylinder port 176 and the second actuator cylinder port 178. The first actuator cylinder port 176 is also fluidly connected to the first fluid return port 160*a*, and the second actuator cylinder port 178 is also fluidly connected to the second fluid return port 160*b*. In operation, fluid can be returned to the first fluid return port 160*a* from the first pressure dividing path 142, the first end 152 of the second stage spool valve 150, and the first actuator cylinder port 176. Fluid can be returned to the second fluid return port 160*b* from the second pressure dividing path 144, the second end 156 of the second stage spool valve 150, and the second actuator cylinder port 178. The centering spring 180 also acts on the second stage spool valve 150 to center the second stage spool valve 150.

During operation of the electro hydraulic servo valve 120 shown in FIGS. 2 and 3, the difference in fluid pressure between the first pressure dividing path 142 (PD1) and the second pressure dividing path 144 (PD2) is less than the difference in fluid pressure between the fluid pressure exiting the first port 82 (P1) and the fluid pressure exiting the second port 84 (P2). Thus, the feedback pressure is reduced from the control pressure.

Figure 4:
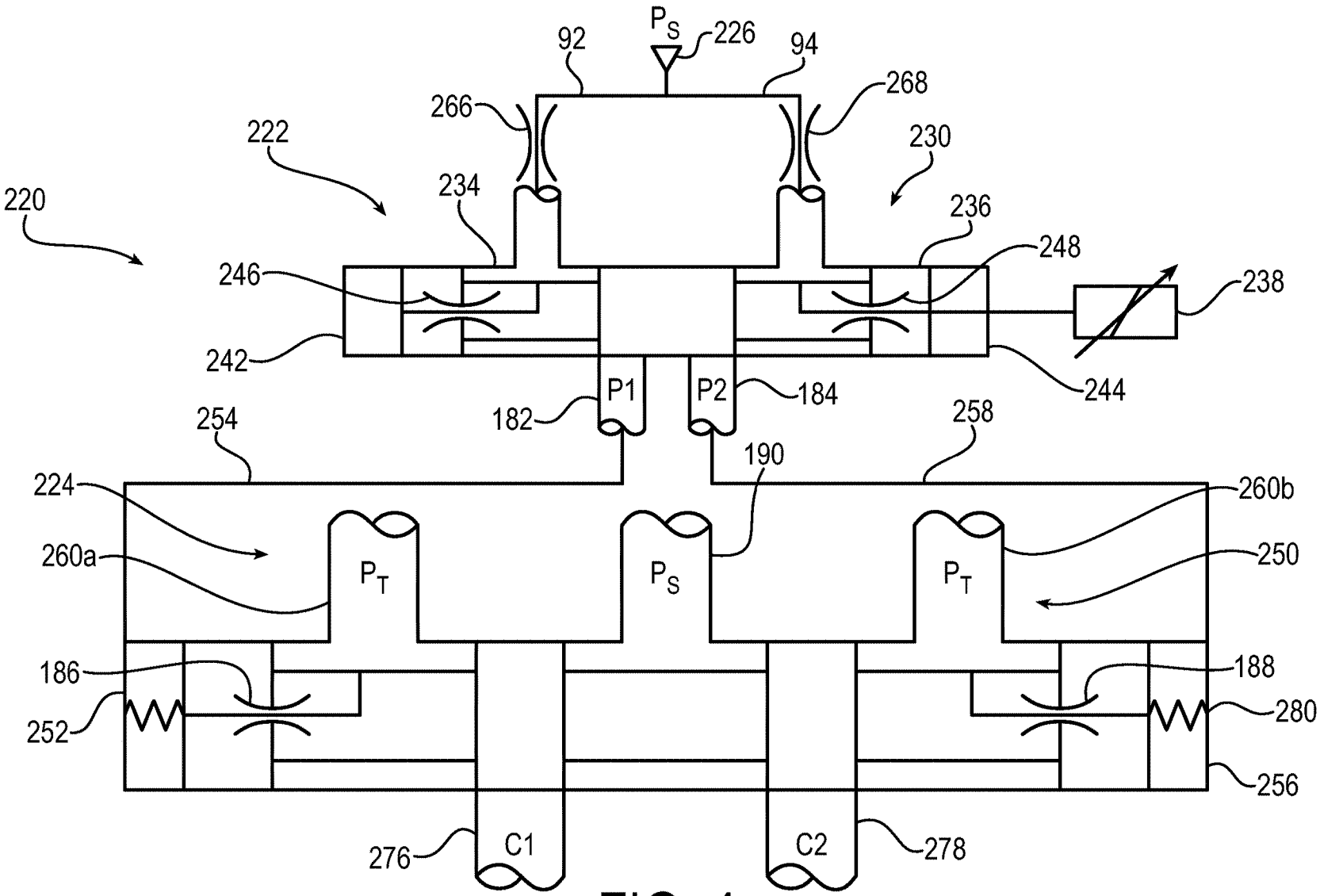
FIG. 4 is a schematic drawing of an electro hydraulic servo valve in accordance with a third embodiment in which the supply pressure is metered and further including an arrangement in which the first stage unit and the second stage unit are not interconnected.
Figure 5:
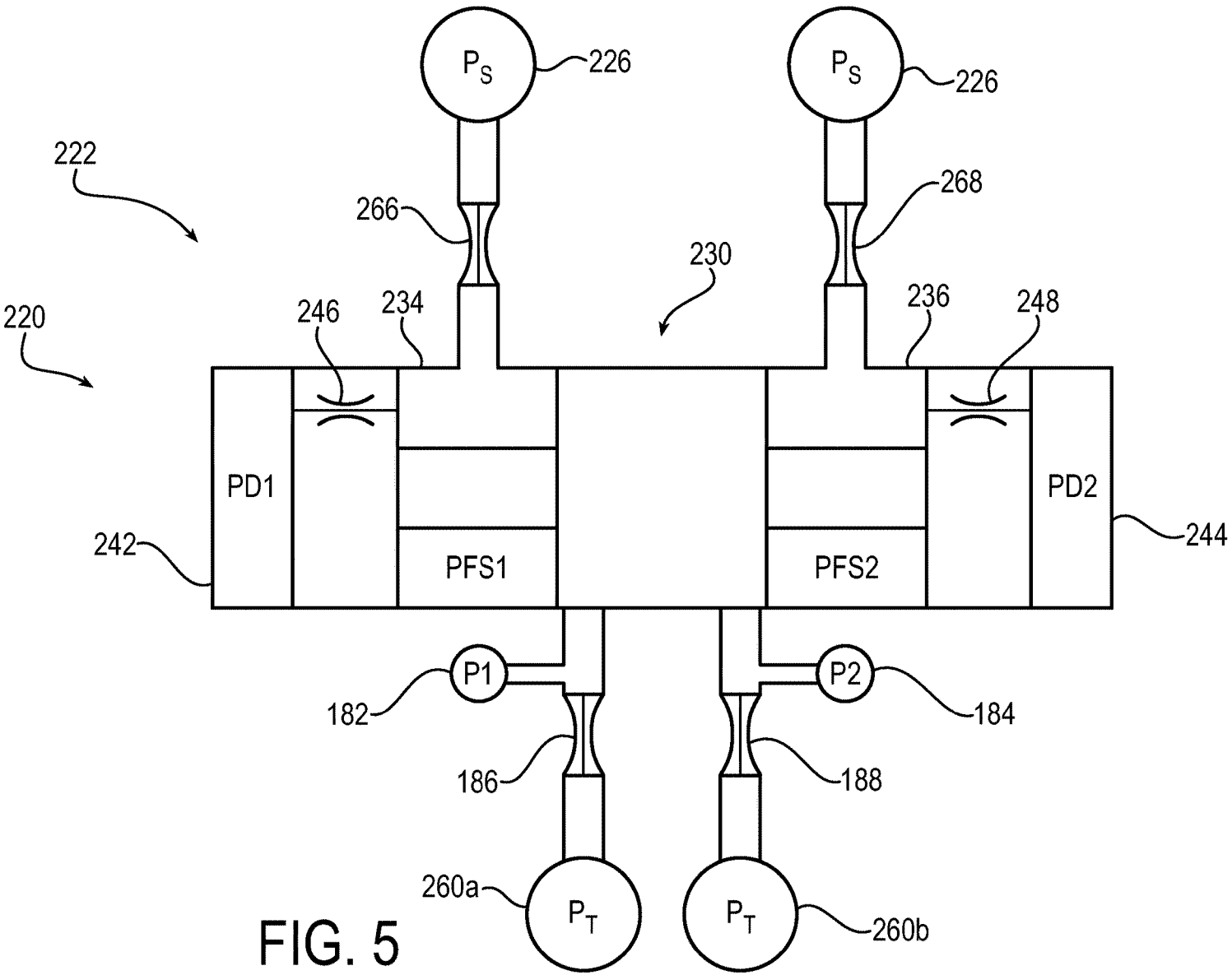
FIG. 5 is a schematic drawing of a first stage unit of the electro hydraulic servo valve of FIG. 4.

Referring now to FIGS. 4 and 5, an electro hydraulic servo valve 220 according to a third embodiment is schematically shown. As in the embodiments shown in FIGS. 1, 2 and 3, the electro hydraulic servo valve 220 is also configured to meter supply pressure. In contrast to the previous embodiments shown in FIGS. 1-3, the first stage unit 222 and the second stage unit 224 are not interconnected.

The electro hydraulic servo valve 220 includes the first stage unit 222 and the second stage unit 224 that control flow to the first actuator cylinder port 276 and the second actuator cylinder port 278. FIG. 5 shows another schematic drawing of the first stage unit 222. The first stage unit 222 is connected to a first fluid supply port 226. The first stage unit 222 includes the direct drive valve 230 that drives the left side first stage spool valve 234 and the right side first stage spool valve 236. The direct drive valve 230 includes a motor having an armature that is driven proportionally to the amount of current applied to coils of the motor via the current control loop 238. The displacement causes movement of both first stage spool valves 234, 236 which is normally in a null position in which fluid is not flowing through the first stage unit 222. The first stage unit 222 is moveable to an open position in which hydraulic fluid is permitted to flow through one of the spool valves 234, 236 to the second stage unit 224.

The first stage unit 222 includes the first pressure dividing path 242 (denoted as PD1 in FIG. 5) connected to the left side first stage spool valve 234 and the second pressure dividing path 244 (denoted as PD2 in FIG. 5) connected to the right side first stage spool valve 236. The first control orifice 246 is arranged along the first pressure dividing path 242 and the second control orifice 248 is arranged along the second pressure dividing path 244.

When the direct drive valve 230 is in the open position, the hydraulic fluid flows through the left side first stage spool valve 234 and the right side first stage spool valve 236 to the first port 182 (P1) and a second port 184 (P2) that are associated with the first stage spool valves 234, 236 respectively. The first port 182 and the second port 184 are in fluid communication with the ends of the second stage spool valve 250. The first port 182 is fluidly connected to the first end 252 of the second stage spool valve 250 via the left second stage supply fluid line 254 and the second port 184 is fluidly connected to the second end 256 via a right second stage supply fluid line 258. Accordingly, fluid is selectively supplied to the second stage unit 224 via the ports 182, 184 and the supply fluid lines 254, 258.

The first stage unit 222 further includes a first fluid return port 260*a* ($P_T$) and a second fluid return port 260*b* ($P_T$) through which hydraulic fluid from the system is returned. The second stage spool valve 250 and the actuator cylinder ports 276, 278 are fluidly connected to the fluid return ports 260*a*, 260*b*. In contrast to the embodiment shown in FIGS. 2 and 3, the first pressure dividing path 242 and the second pressure dividing path 244 are not directly fluidly connected to the fluid return ports 260*a*, 260*b*.

The first stage unit 222 further includes a left first stage supply fluid line 92 connected between the first stage supply fluid port 226 and the left side first stage spool valve 234, and a right first stage supply fluid line 94 connected between the first stage supply fluid port 226 and the right side first stage spool valve 236. A third control orifice 266 is arranged along the left first stage supply fluid line 92. A fourth control orifice 268 is arranged along the right first stage supply fluid line 94.

In operation, the left side first stage spool valve 234 is moveable to a first position in which the first stage supply fluid port 226 is in fluid communication with the left side first stage spool valve 234 through which hydraulic fluid flows to the first end 252 of the second stage spool valve 250, and a second position in which the first stage supply fluid port 226 is in fluid communication with the first pressure dividing path 242 through which hydraulic fluid flows to the left side first stage spool valve 234. Similarly, the right side first stage spool valve 236 is moveable to a first position in which the first stage supply fluid port 226 is in fluid communication with the right side first stage spool valve 236 through which hydraulic fluid flows to the second end 256 of the second stage spool valve 150, and a second position in which the first stage supply fluid port 226 is in fluid communication with the second pressure dividing path 244 through which hydraulic fluid flows to the right side first stage spool valve 236.

The second stage unit 224 is normally in a closed position. When hydraulic fluid is supplied to the second stage unit 224, the second stage unit 224 is moveable to an operational position, in which the second stage spool valve 250 is open and in which hydraulic fluid is supplied and returned from the first actuator cylinder port 276 and the second actuator cylinder port 278. Any number of actuator cylinders, or second stage outputs, may be used. The second stage spool valve 250 may include a fifth control orifice 186 that is associated with the first end 252 of the second stage spool valve 250 and a sixth control orifice 188 that is associated with the second end 256. The fifth control orifice 186 is fluidly connected between the left second stage supply fluid line 254 and the second stage spool valve 250. The sixth control orifice 188 is fluidly connected between the right second stage supply fluid line 258 and the second stage spool valve 250.

The second stage unit 224 further includes a second stage supply pressure port 190 that supplies fluid directly to the first actuator cylinder port 276 and the second actuator cylinder port 278. The first actuator cylinder port 276 is also fluidly connected to the first fluid return port 260*a*, and the second actuator cylinder port 278 is also fluidly connected to the second pressure return report 260*b*. In operation, fluid can be returned to the first fluid return port 260*a* from the first end 252 of the second stage spool valve 250, and the first actuator cylinder port 276. Fluid can be returned to the second fluid return port 260*b* from the second end 256 of the second stage spool valve 250, and the second actuator cylinder port 278. The centering spring 280 also acts on the second stage spool valve 250 to center the second stage spool valve 250.

During operation of the electro hydraulic servo valve 220 shown in FIGS. 4 and 5, the difference in fluid pressure between the first pressure dividing path 242 (PD1) and the second pressure dividing path 244 (PD2) is less than the difference in fluid pressure between the fluid pressure exiting the first port 182 (P1) and the fluid pressure exiting the second port 184 (P2). Thus, the feedback pressure is reduced from the control pressure.

Figure 6:
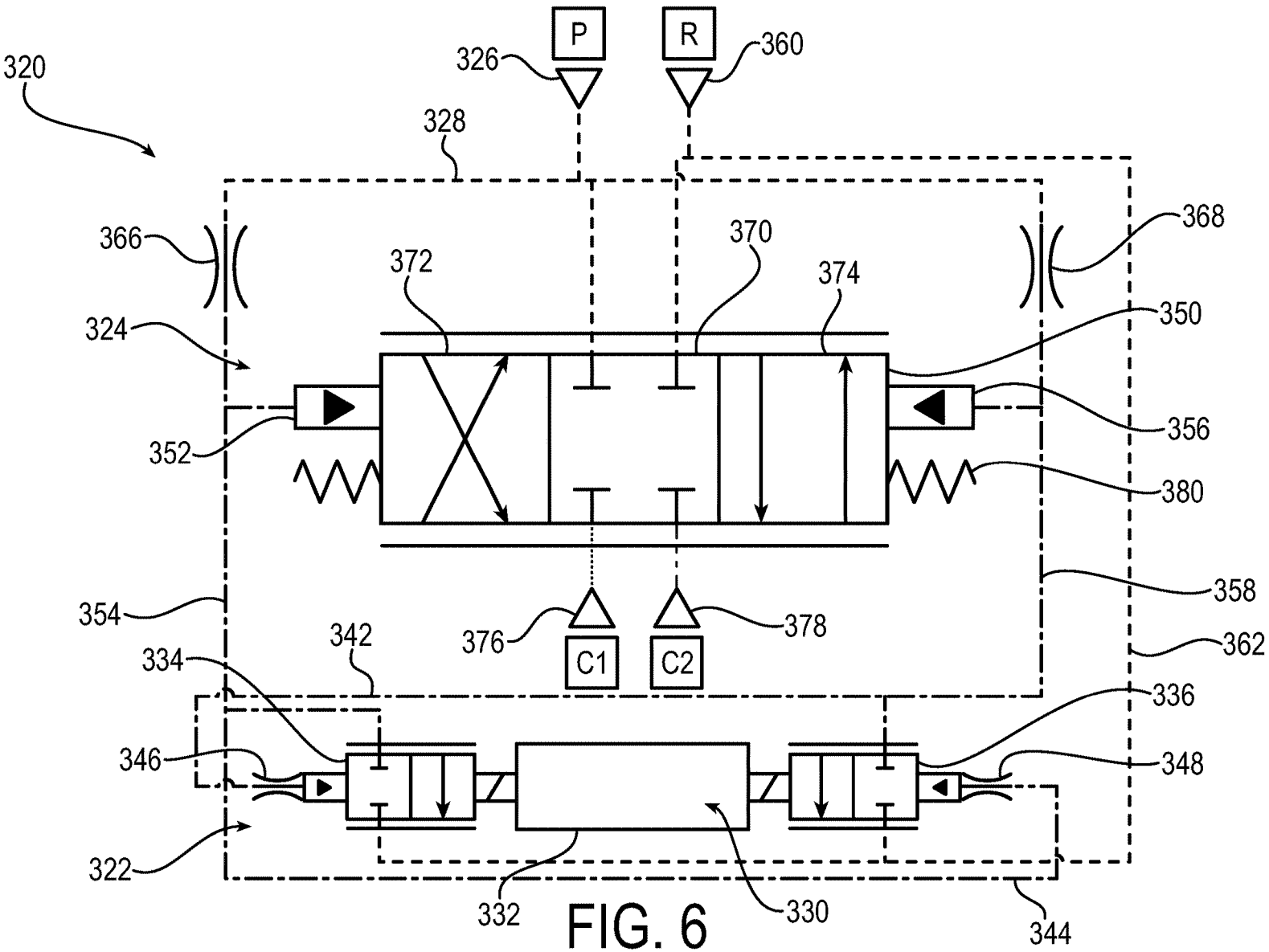
FIG. 6 is a schematic drawing of an electro hydraulic valve in accordance with a fourth embodiment in which the return pressure is metered.

Referring now to FIG. 6, an electro hydraulic servo valve 320 according to a fourth embodiment is schematically shown. In contrast to the embodiments shown in FIGS. 1-5 that meter supply pressure, the electro hydraulic servo valve 320 is configured to meter return pressure.

The electro hydraulic servo valve 320 includes the first stage unit 322 and the second stage unit 324 that controls flow to the actuator cylinders 376, 378. The first stage unit 322 and the second stage unit 324 are fluidly connected to the fluid supply port 326 via the fluid supply line 328. The first stage unit 322 includes a direct drive valve 330 having the motor 332 that drives the left side first stage spool valve 334 and the right side first stage spool valve 336. The first stage unit 322 includes the first pressure feedback fluid line 342 that is connected to the left side first stage spool valve 334 and the second side 356 of the second stage spool valve 350. The first stage unit 322 includes the second pressure feedback fluid line 344 that is connected to the right side first stage spool valve 336 and the first end 352 of the second stage spool valve 350. The first control orifice 346 is arranged along the first pressure feedback fluid line 342 and the second control orifice 348 is arranged along the second pressure feedback fluid line 344.

The first stage unit 322 is moveable to an open position in which hydraulic fluid is permitted to flow through the first stage spool valves 334, 336 and to the fluid return port 360 via a first return fluid line 362. The second stage unit 324 is supplied hydraulic supply fluid that flows directly to the second stage unit 324 via the fluid supply line 328. The second stage unit 324 includes the pilot operated hydraulic directional second stage spool valve 350 that has the first end 352 that is fluidly connected to the left side first stage spool valve 334 of the first stage unit 322 via the left second stage supply fluid line 354. The second stage spool valve 350 has the second end 356 that is fluidly connected to the right side first stage spool valve 336 of the first stage unit 322 via the right second stage supply fluid line 358. Accordingly, the ends 352, 356 of the second stage spool valve 350 are only fluidly connected to the first stage unit 322. The ends 352, 356 are not directly fluidly connected to the fluid return port 360.

A third control orifice 366 and a fourth control orifice 368 are arranged along the fluid supply line 328 such that fluid can flow from the fluid supply 236 through the control orifices 366, 368 and to the ends 352, 356 or to the first stage unit 322. Any suitable number of control orifices may be used. The second stage unit 324 is normally in a closed position 370 and is moveable to the operational position, in which the second stage spool valve 350 is open. The second stage spool valve 350 has the first operational position 372 and a second operational position 374 in which hydraulic fluid is supplied and returned from the first actuator cylinder 376 (C1) and the second actuator cylinder 378 (C2). In the first operational position 372, fluid is supplied to the second actuator cylinder 378 and returned from the first actuator cylinder 376. In the second operational position 374, fluid is supplied to the first actuator cylinder 376 and returned from the second actuator cylinder 378. Any number of actuator cylinders, or second stage outputs, may be used. The second stage unit 324 further includes the centering spring 380 that centers the second stage spool valve 350.

In operation, the centering spring 380 acts on the second stage spool valve 350 resulting in the force equilibrium and the motion of the second stage spool valve 350 is arrested when the force equilibrium is restored. The pressure differential of the second stage spool valve 350 is also fed back to the first stage unit 322. Pressure is fed back from the second end 356 of the second stage spool valve 350 through the first pressure feedback fluid line 342 to the left side first stage spool valve 334. Pressure is fed back from the first end 352 of the second stage spool valve 350 through the second pressure feedback line 344 to the right side first stage spool valve 336. The motion of the first stage unit 322 is arrested when the force equilibrium is restored by the feedback pressure. Accordingly, the output delta pressure of the first stage unit 322 is proportional to the current of the motor 232.

An electro hydraulic servo valve includes a first stage unit including a moveable direct drive valve, a second stage unit including a centering spring and a second stage spool valve that is fluidly connected to the moveable direct drive valve, and at least one pressure feedback fluid line fluidly connected to the first stage unit. The moveable direct drive valve selectively supplies fluid pressure to the second stage unit. Motion of the second stage unit is arrested using the centering spring. Motion of the first stage unit is arrested when pressure is fed back to the first stage unit. A supply pressure or a return pressure is metered using the pressure feedback fluid line.

The at least one pressure feedback fluid line includes at least one control orifice, whereby movement of the first stage unit is damped.

The moveable direct drive valve includes a first first stage spool valve, a second first stage spool valve, and a motor that drives the first first stage spool valve and the second first stage spool valve. The second stage spool valve has a first end and a second end opposite the first end, the first first stage spool valve being fluidly connected to the first end and the second first stage spool valve being fluidly connected to the second end of the second stage spool to selectively supply fluid pressure to the first end and the second end. The at least one pressure feedback fluid line includes a first pressure feedback fluid line that is connected to the first first stage spool valve and has a first control orifice, and a second pressure feedback fluid line that is connected to the second first stage spool valve and has a second control orifice.

The first end of the second stage spool valve is fluidly connected to the first pressure feedback fluid line and the second end of the second stage spool valve is fluidly connected to the second pressure feedback fluid line. The second stage unit is configured to feed a pressure differential across the second stage spool valve back to the first stage unit, and a position of the second stage spool valve is linearly proportional to the pressure differential across the second stage spool valve.

The electro hydraulic servo valve may further include at least one return port, a left second stage supply fluid line connected between the first first stage spool valve and the first end of the second stage spool valve, a right second stage supply fluid line connected between the second first stage spool valve and the second end of the second stage spool valve, a first end second stage return fluid line connected between the first end of the second stage spool valve and the at least one return port, and a second end second stage return fluid line connected between the second end of the second stage spool valve and the at least one return port.

The electro hydraulic servo valve may further include at least one first stage supply pressure port. The first first stage spool valve or the second first stage spool valve is moveable between a first position in which the at least one supply pressure port is in fluid communication with the first first stage spool valve or the second first stage spool valve, and a second position in which the at least one supply pressure port is in fluid communication with the first pressure feedback fluid line through the first control orifice or the second pressure feedback fluid line through the second control orifice.

The electro hydraulic servo valve may further include a left first stage return fluid line connected between the first pressure feedback line and the at least one return port, and a right first stage return fluid line connected between the second pressure feedback line and the at least one return port.

The electro hydraulic servo valve may further include a third control orifice arranged along the left first stage return fluid line, and a fourth control orifice arranged along the right first stage return fluid line.

The electro hydraulic servo valve may further include a fifth control orifice arranged along the left second stage supply fluid line, and a sixth control orifice arranged along the right second stage supply fluid line.

The electro hydraulic servo valve may further include a second stage supply fluid port, a first cylinder port that is fluidly connected to the second stage supply fluid port and the at least one return port, and a second cylinder port that is fluidly connected to the second stage supply fluid port and the at least one return port. One of the first cylinder port and the second cylinder port receives hydraulic fluid from the second stage supply fluid port and the other of the first cylinder port and the second cylinder port discharges hydraulic fluid to the at least one return port during operation of the electro hydraulic servo valve.

The electro hydraulic servo valve may further include a first stage supply fluid port, a left first stage supply fluid line connected between the first stage supply fluid port and the first first stage spool valve, and a right first stage supply fluid line connected between the first stage supply fluid port and the second first stage spool valve.

The electro hydraulic servo valve may further include a third control orifice arranged on the left first stage supply fluid line, and a fourth control orifice arranged on the right first stage supply fluid line.

The first pressure feedback fluid line has a first end and a second end that are both connected to the first first stage spool valve, and the second pressure feedback fluid line has a first end and a second end that are both connected to the second first stage spool valve.

The electro hydraulic servo valve may further include a fluid supply pressure port, a first supply pressure fluid line connected between the fluid supply pressure port and the first end of the second stage spool, a second supply pressure fluid line connected between the fluid supply pressure port and the second end of the second stage spool, a third control orifice arranged on the first supply pressure fluid line, and a fourth control orifice arranged on the second supply pressure fluid line.

The third control orifice is fluidly connected to the second control orifice and the fourth control orifice is fluidly connected to the first control orifice.

The electro hydraulic servo valve may further include a current control loop for applying voltage to coils of the motor.

The motor may be a linear force motor and the direct drive valve may include a linear valve driven by the linear force motor.

The motor may be a torque motor and the direct drive valve may include a rotary valve driven by the torque motor.

An electro hydraulic servo valve includes a first stage unit including a moveable direct drive valve having a first first stage spool valve, a second first stage spool valve, and a motor that drives the first first stage spool valve and the second first stage spool valve, a second stage unit including a centering spring and a second stage spool valve having a first end and a second end opposite the first end, a first pressure feedback fluid line that is connected to the first first stage spool valve and has a first control orifice, and a second pressure feedback fluid line that is connected to the second first stage spool valve and has a second control orifice. The first first stage spool valve is fluidly connected to the first end and the second first stage spool valve is fluidly connected to the second end of the second stage spool to selectively supply fluid pressure to the first end and the second end. A supply pressure is metered using the first pressure feedback fluid line and the second pressure feedback fluid line, and the second stage unit is configured to feed a pressure differential across the second stage spool valve back to the first stage unit.

A method of pressure control is used in an electro hydraulic servo valve. The method includes fluidly connecting at least one pressure feedback fluid line to a first stage unit having a direct drive, supplying hydraulic fluid to the first stage unit, supplying hydraulic fluid selectively to a spool of a second stage unit, the direct drive valve being fluidly connected to the spool, and feeding a pressure differential of the second stage unit back to the first stage unit.

The method may further include dampening the first stage unit by arranging a control orifice at a first side of the first stage unit and a second control orifice at a second side of the first stage unit.

The method may further include arresting motion of the first stage unit when pressure is fed back to the first stage unit from the second stage unit.

The method may further include arresting motion of the second stage unit using a centering spring.

The method may further include applying voltage to coils of a motor that operates the direct drive valve, wherein when the first stage unit is in an arrested position, an output pressure of the first stage unit is proportional to current of the motor, wherein when the second stage unit is in an arrested position, an output pressure of the second stage unit is proportional to the current of the motor.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electro hydraulic servo valve comprising:

a first stage unit including a moveable direct drive valve driven by a motor, wherein the moveable direct drive valve includes a first first stage spool valve and a second first stage spool valve;

a second stage unit including a centering spring and a second stage spool valve that is fluidly connected to the moveable direct drive valve, wherein the second stage spool valve has a first end and a second end opposite the first end, the first first stage spool valve being fluidly connected to the first end and the second first stage spool valve being fluidly connected to the second end of the second stage spool to selectively supply fluid pressure to the first end and the second end, wherein the moveable direct drive valve selectively supplies fluid pressure to the second stage unit, wherein displacement of an armature of the motor is proportional to current being applied to the motor thereby causing a differential pressure across the second stage unit, wherein motion of the second stage unit is arrested using the centering spring whereby a position of the second stage unit is proportional to the current of the motor; and at least one pressure feedback fluid line fluidly connected to the first stage unit, wherein motion of the first stage unit is arrested when pressure is fed back to the first stage unit from the second stage unit, and wherein a supply pressure or a return pressure is metered using the pressure feedback fluid line, wherein the at least one pressure feedback fluid line includes a first pressure feedback fluid line that is connected to the first first stage spool valve and has a first control orifice, and a second pressure feedback fluid line that is connected to the second first stage spool valve and has a second control orifice;

at least one return port;

a left second stage supply fluid line connected between the first first stage spool valve and the first end of the second stage spool valve;

a right second stage supply fluid line connected between the second first stage spool valve and the second end of the second stage spool valve;

a first end second stage return fluid line connected between the first end of the second stage spool valve and the at least one return port; and a second end second stage return fluid line connected between the second end of the second stage spool valve and the at least one return port.

2. The electro hydraulic servo valve according to claim 1, wherein the at least one pressure feedback fluid line includes at least one control orifice, whereby movement of the first stage unit is damped.

3. The electro hydraulic servo valve according to claim 1, wherein the first end of the second stage spool valve is fluidly connected to the first pressure feedback fluid line and the second end of the second stage spool valve is fluidly connected to the second pressure feedback fluid line, wherein the second stage unit is configured to feed a pressure differential across the second stage spool valve back to the first stage unit, and wherein a position of the second stage spool valve is linearly proportional to the pressure differential across the second stage spool valve.

4. The electro hydraulic servo valve according to claim 1 further comprising at least one first stage supply pressure port, wherein the first first stage spool valve or the second first stage spool valve is moveable between a first position in which the at least one supply pressure port is in fluid communication with the first first stage spool valve or the second first stage spool valve, and a second position in which the at least one supply pressure port is in fluid communication with the first pressure feedback fluid line through the first control orifice or the second pressure feedback fluid line through the second control orifice.

5. The electro hydraulic servo valve according to claim 1 further comprising:

a left first stage return fluid line connected between the first pressure feedback line and the at least one return port; and a right first stage return fluid line connected between the second pressure feedback line and the at least one return port.

6. The electro hydraulic servo valve according to claim 5 further comprising:

a third control orifice arranged along the left first stage return fluid line; and a fourth control orifice arranged along the right first stage return fluid line.

7. The electro hydraulic servo valve according to claim 6 further comprising:

a fifth control orifice arranged along the left second stage supply fluid line; and a sixth control orifice arranged along the right second stage supply fluid line.

8. The electro hydraulic servo valve according to claim 1 further comprising:

a second stage supply fluid port;

a first cylinder port that is fluidly connected to the second stage supply fluid port and the at least one return port; and a second cylinder port that is fluidly connected to the second stage supply fluid port and the at least one return port, wherein one of the first cylinder port and the second cylinder port receives hydraulic fluid from the second stage supply fluid port and the other of the first cylinder port and the second cylinder port discharges hydraulic fluid to the at least one return port during operation of the electro hydraulic servo valve.

9. The electro hydraulic servo valve according to claim 1 further comprising:

a first stage supply fluid port;

a left first stage supply fluid line connected between the first stage supply fluid port and the first first stage spool valve;

a right first stage supply fluid line connected between the first stage supply fluid port and the second first stage spool valve;

a third control orifice arranged on the left first stage supply fluid line; and a fourth control orifice arranged on the right first stage supply fluid line wherein the first pressure feedback fluid line has a first end and a second end that are both connected to the first first stage spool valve, and wherein the second pressure feedback fluid line has a first end and a second end that are both connected to the second first stage spool valve.

10. The electro hydraulic servo valve according to claim 1 further comprising a current control loop for applying voltage to coils of the motor.

11. The electro hydraulic servo valve according to claim 10, wherein the motor is a linear force motor and the direct drive valve includes a linear valve driven by the linear force motor, or the motor is a torque motor and the direct drive valve includes a rotary valve driven by the torque motor.

12. A method of pressure control in an electro hydraulic servo valve having the electro hydraulic servo valve of claim 1, the method comprising:

fluidly connecting the at least one pressure feedback fluid line to the first stage unit having the movable direct drive valve driven by the motor;

supplying hydraulic fluid to the first stage unit;

supplying hydraulic fluid selectively to a spool of the second stage unit, the movable direct drive valve being fluidly connected to the spool, wherein displacement of the armature of the motor is proportional to current being applied to the motor thereby causing the differential pressure across the second stage unit;

arresting motion of the second stage unit using the centering spring whereby a position of the second stage unit is proportional to the current of the motor; and feeding the pressure differential of the second stage unit back to the first stage unit.

13. The method according to claim 12 further comprising dampening the first stage unit by arranging a control orifice at a first side of the first stage unit and a second control orifice at a second side of the first stage unit.

14. The method according to claim 12 further comprising arresting motion of the first stage unit when pressure is fed back to the first stage unit from the second stage unit.

15. The method according to claim 12 further comprising applying voltage to coils of the motor that operates the direct drive valve, wherein when the first stage unit is in an arrested position, an output pressure of the first stage unit is proportional to current of the motor, wherein when the second stage unit is in an arrested position, an output pressure of the second stage unit is proportional to the current of the motor.

16. An electro hydraulic servo valve comprising:

a first stage unit including a moveable direct drive valve;

a second stage unit including a centering spring and a second stage spool valve that is fluidly connected to the moveable direct drive valve, wherein the moveable direct drive valve selectively supplies fluid pressure to the second stage unit, wherein motion of the second stage unit is arrested using the centering spring;

at least one pressure feedback fluid line fluidly connected to the first stage unit, wherein motion of the first stage unit is arrested when pressure is fed back to the first stage unit, and wherein a supply pressure or a return pressure is metered using the pressure feedback fluid line;

at least one return port;

a left second stage supply fluid line connected between a first first stage spool valve and a first end of the second stage spool valve;

a right second stage supply fluid line connected between a second first stage spool valve and a second end of the second stage spool valve;

a first end second stage return fluid line connected between the first end of the second stage spool valve and the at least one return port; and a second end second stage return fluid line connected between the second end of the second stage spool valve and the at least one return port.

17. An electro hydraulic servo valve comprising:

a first stage unit including a moveable direct drive valve driven by a motor, wherein the moveable direct drive valve includes a first first stage spool valve, a second first stage spool valve;

a second stage unit including a centering spring and a second stage spool valve that is fluidly connected to the moveable direct drive valve, wherein the second stage spool valve has a first end and a second end opposite the first end, the first first stage spool valve being fluidly connected to the first end and the second first stage spool valve being fluidly connected to the second end of the second stage spool to selectively supply fluid pressure to the first end and the second end, wherein the moveable direct drive valve selectively supplies fluid pressure to the second stage unit, wherein displacement of an armature of the motor is proportional to current being applied to the motor thereby causing a differential pressure across the second stage unit, wherein motion of the second stage unit is arrested using the centering spring whereby a position of the second stage unit is proportional to the current of the motor;

at least one pressure feedback fluid line fluidly connected to the first stage unit, wherein motion of the first stage unit is arrested when pressure is fed back to the first stage unit from the second stage unit, and wherein a supply pressure or a return pressure is metered using the pressure feedback fluid line, wherein the at least one pressure feedback fluid line includes a first pressure feedback fluid line that is connected to the first first stage spool valve and has a first control orifice, and a second pressure feedback fluid line that is connected to the second first stage spool valve and has a second control orifice;

a fluid supply pressure port;

a first supply pressure fluid line connected between the fluid supply pressure port and the first end of the second stage spool;

a second supply pressure fluid line connected between the fluid supply pressure port and the second end of the second stage spool;

a third control orifice arranged on the first supply pressure fluid line; and a fourth control orifice arranged on the second supply pressure fluid line, wherein the third control orifice is fluidly connected to the second control orifice and the fourth control orifice is fluidly connected to the first control orifice.

* * * * *